US011519606B1

(12) United States Patent
Cadima

(10) Patent No.: US 11,519,606 B1
(45) Date of Patent: Dec. 6, 2022

(54) BURNER WITH AN OPTIONAL PILOT

(71) Applicant: Haier US Appliance Solutions, Inc., Wilmington, DE (US)

(72) Inventor: Paul Bryan Cadima, Crestwood, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/404,320

(22) Filed: Aug. 17, 2021

(51) Int. Cl.
*F24C 3/10* (2006.01)
*F23D 14/06* (2006.01)

(52) U.S. Cl.
CPC ..... *F24C 3/103* (2013.01); *F23D 14/06* (2013.01); *F23D 2207/00* (2013.01); *F23D 2900/14062* (2013.01)

(58) Field of Classification Search
CPC ..... F24C 3/103; F24C 3/10; F23D 2207/00; F23D 14/06
USPC ..... 431/266; 126/39 R, 39 E
See application file for complete search history.

(56) References Cited

U.S. PATENT DOCUMENTS 2,474,547 A 6/1949 Patch
2,993,533 A * 7/1961 Landgraf ..... F24C 3/10 431/283
3,627,462 A 12/1971 Lotter
5,911,572 A * 6/1999 Williams ..... F24C 3/103 313/143
6,132,205 A 10/2000 Harneit
6,254,381 B1 * 7/2001 Baynham ..... F24C 3/103 126/39 E
2002/0092515 A1 * 7/2002 Lubrina ..... F24C 3/103 126/39 B
2009/0068601 A1 * 3/2009 Londerville ..... F23D 1/00 431/12
2011/0120445 A1 * 5/2011 Armanni ..... F23D 14/06 126/39 E
2011/0143293 A1 * 6/2011 Chung ..... F24C 3/103 431/255
2011/0232628 A1 * 9/2011 Bettinzoli ..... F23D 14/58 126/39 E
2013/0206128 A1 * 8/2013 Sovar ..... F24C 3/126 126/42
2020/0278115 A1 * 9/2020 Hensley ..... F24C 3/122

FOREIGN PATENT DOCUMENTS

CA 2362967 A1 8/2000
CN 111503636 A 8/2020
JP 5184571 B2 4/2013
TW M375845 U 3/2010

* cited by examiner

*Primary Examiner* — Vivek K Shirsat
(74) *Attorney, Agent, or Firm* — Dority & Manning, P.A.

(57) ABSTRACT

A burner assembly includes a base body. A cap is positioned on the base body such that the base body and the cap collectively define a plurality of flame ports. A pilot insert is mounted to the base body. The pilot insert and the base body collectively defining a pilot port. An igniter is configured to generate an ignition spark. An upper spark target is positioned proximate the plurality of flame ports, and a lower spark target is positioned proximate the pilot port. An electrode of the igniter is positionable proximate either the upper spark target or the lower spark target.

20 Claims, 10 Drawing Sheets

BURNER WITH AN OPTIONAL PILOT

FIELD OF THE INVENTION

The present subject matter relates generally to gas burners for appliances.

BACKGROUND OF THE INVENTION

Certain gas burners can be automatically controlled in order to maintain a selected cookware temperature, e.g., during sous vide style cooking. Such gas burners can rely upon a pilot flame for a discrete low heat output that is less than a minimum heat output of a burner ring. The discrete low heat output of the pilot flame can maintain water at a relatively low temperature for extended times during sous vide style cooking. The pilot flame can also reignite adjacent burner rings without the need to use a noisy spark from an igniter.

Adding a pilot flame to a gas burner has drawbacks. In certain gas burners, the pilot flame port(s) are positioned outside of and adjacent to the burner ring. In such arrangements, the pilot flame is exposed, and the heat from the pilot flame is remote from a center of the cookware. Moreover, the heat of the pilot flame is focused, which frequently results in overheating of food items directly above the pilot flame due to a lack of heat diffusion rather than total heat output of the pilot flame. In practice, manufacturers frequently have separate designs for gas burners with a pilot flame and for gas burners without a pilot flame, which requires separate, expensive tooling.

BRIEF DESCRIPTION OF THE INVENTION

Aspects and advantages of the invention will be set forth in part in the following description, or may be apparent from the description, or may be learned through practice of the invention.

In one example embodiment, a burner assembly includes a ring base. A cap is positioned on the ring base such that the ring base and the cap collectively define a plurality of flame ports. A pilot insert is mounted to the ring base below the plurality of flame ports. The pilot insert and the ring base collectively define a pilot port. An igniter is configured to generate an ignition spark. The cap defines an upper spark target for the plurality of flame ports, and the ring base defines a lower spark target for the pilot port. The upper spark target is aligned with the lower spark target. An electrode of the igniter is positionable proximate either the upper spark target or the lower spark target.

In another example embodiment, a burner assembly includes a base body. A cap is positioned on the base body such that the base body and the cap collectively define a plurality of flame ports. A pilot insert is mounted to the base body. The pilot insert and the base body collectively defining a pilot port. The pilot port is positioned below the plurality of flame ports. An igniter is configured to generate an ignition spark. An upper spark target is positioned proximate the plurality of flame ports, and a lower spark target is positioned proximate the pilot port. An electrode of the igniter is positionable proximate either the upper spark target or the lower spark target.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
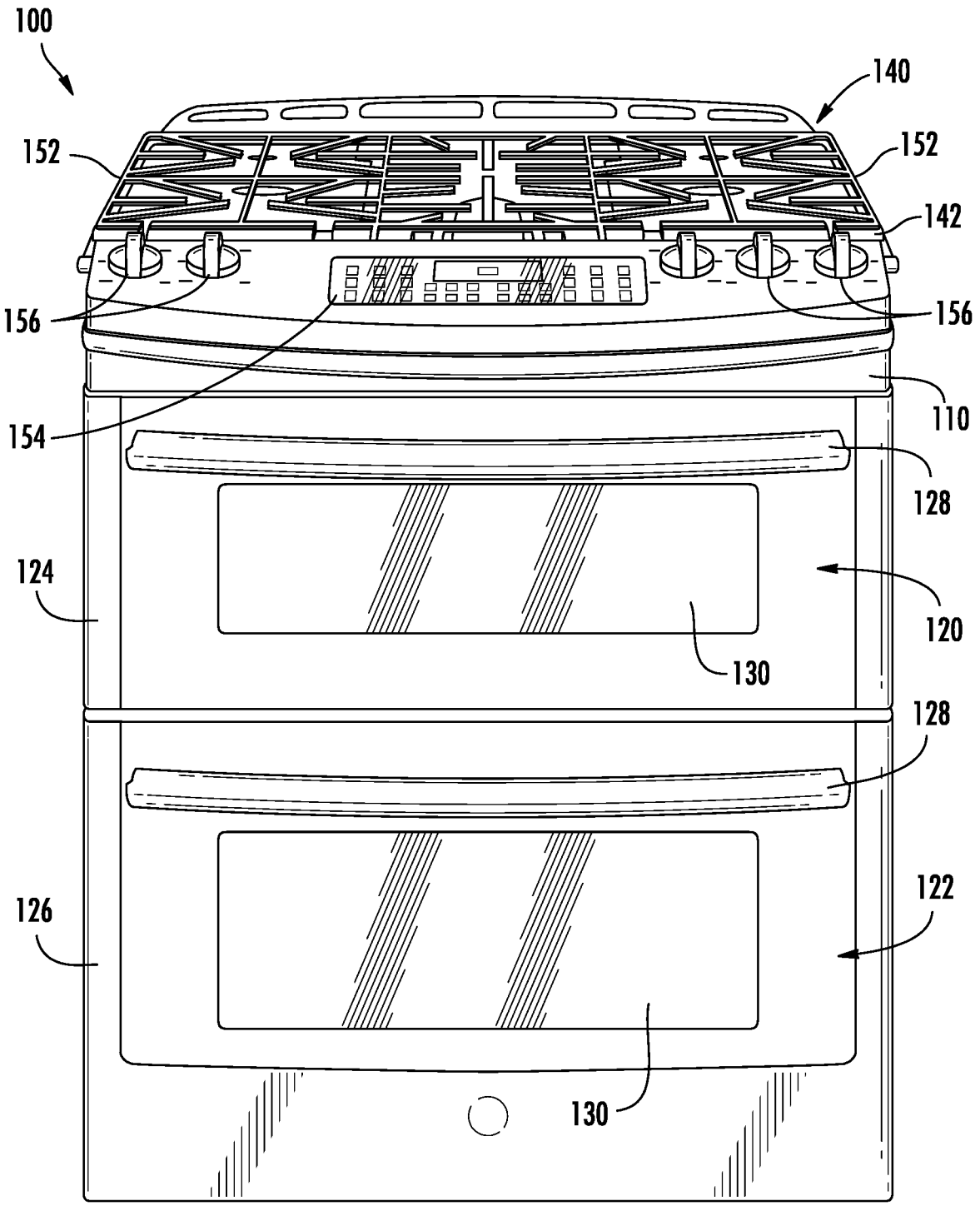
FIG. 1 is a front, perspective view of a range appliance according to an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
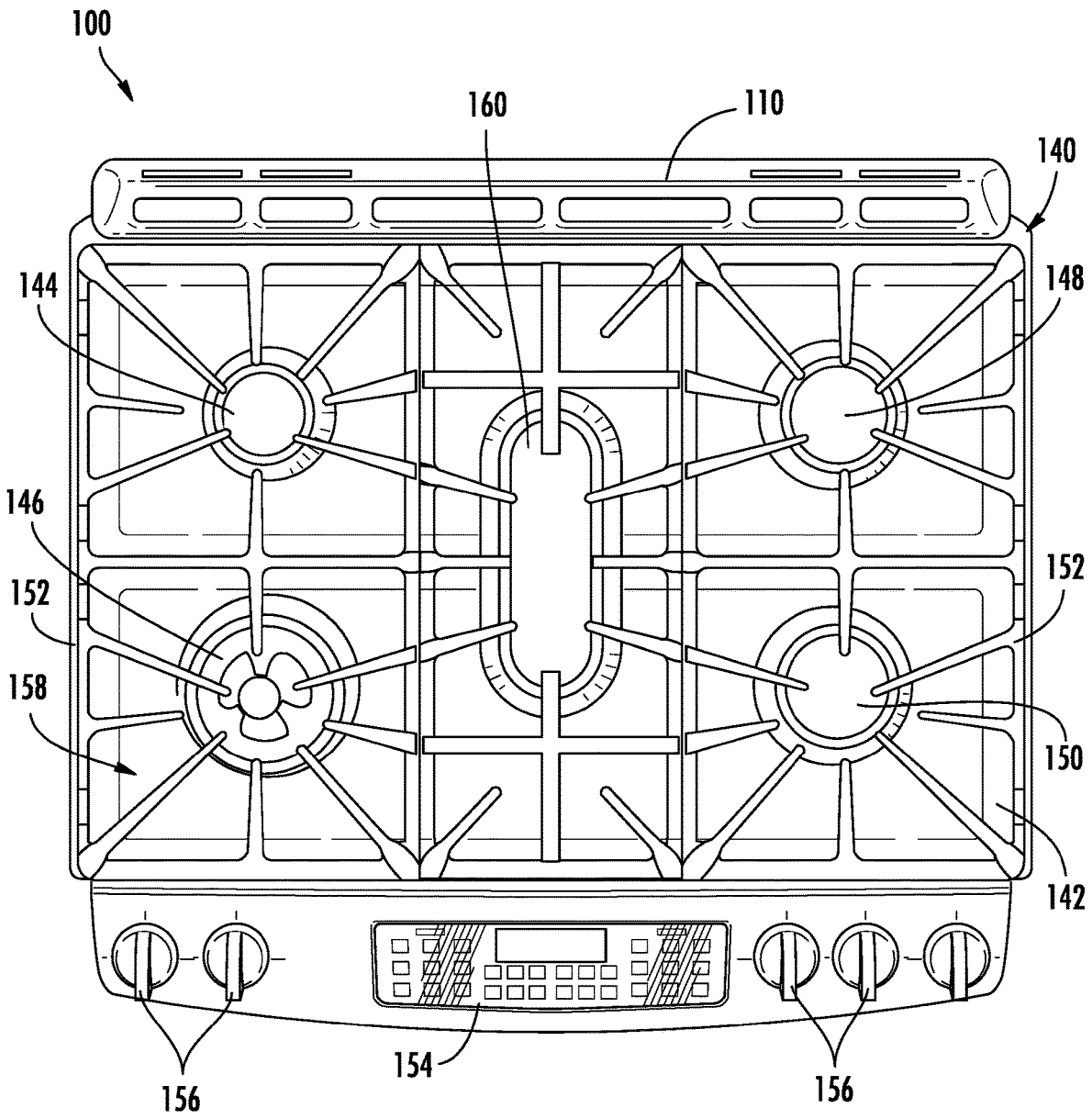
FIG. 2 is a top, plan view of the example range appliance of FIG. 1.

Turning now to the figures, FIG. 1 provides a front, perspective view of a range appliance 100 as may be employed with the present disclosure. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present disclosure may be used in any suitable appliance (e.g., a single oven range appliance or a standalone cooktop appliance). Thus, the exemplary embodiment shown in FIG. 1 is not intended to limit the present disclosure to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass windowpanes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof. Moreover, top panel 142 may be formed as a unitary, single piece or, alternatively, as multiple discrete pieces joined together.

For range appliance 100, a utensil holding food or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide, for example, for the receipt of cooking utensils (e.g., pots, pans, etc.) of various sizes and configurations and to provide different heat inputs for such cooking utensils. Grates 152 may be supported on a top surface 158 of top panel 142. In optional embodiments, range appliance 100 includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as, for example, whether a particular burner assembly is activated or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Turning now to FIGS. 3 through 10, various views are provided of a gas burner assembly 200 according to an exemplary embodiment of the present disclosure. As an example, burner assembly 200 may be used in range appliance 100 (FIG. 2) as one of burner assemblies 144, 146, 148, 150. Nonetheless, it will be understood that, while describe in greater detail below in the context of range appliance 100, burner assembly 200 may be used in or with any suitable appliance in alternative exemplary embodiments.

Figure 3:
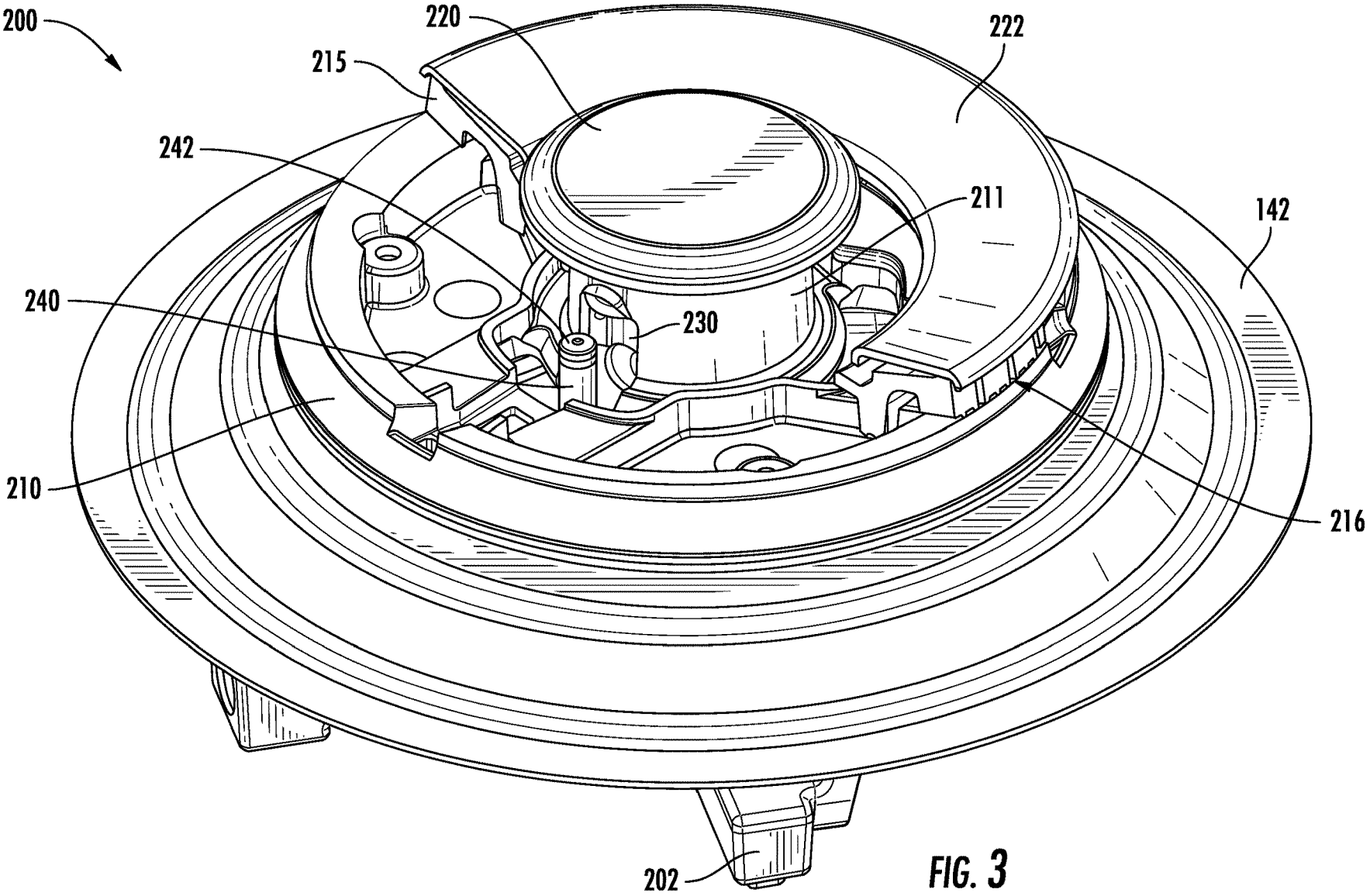
FIG. 3 is a perspective, partial section view of a gas burner according to an example embodiment of the present disclosure in a non-pilot configuration.
Figure 4:
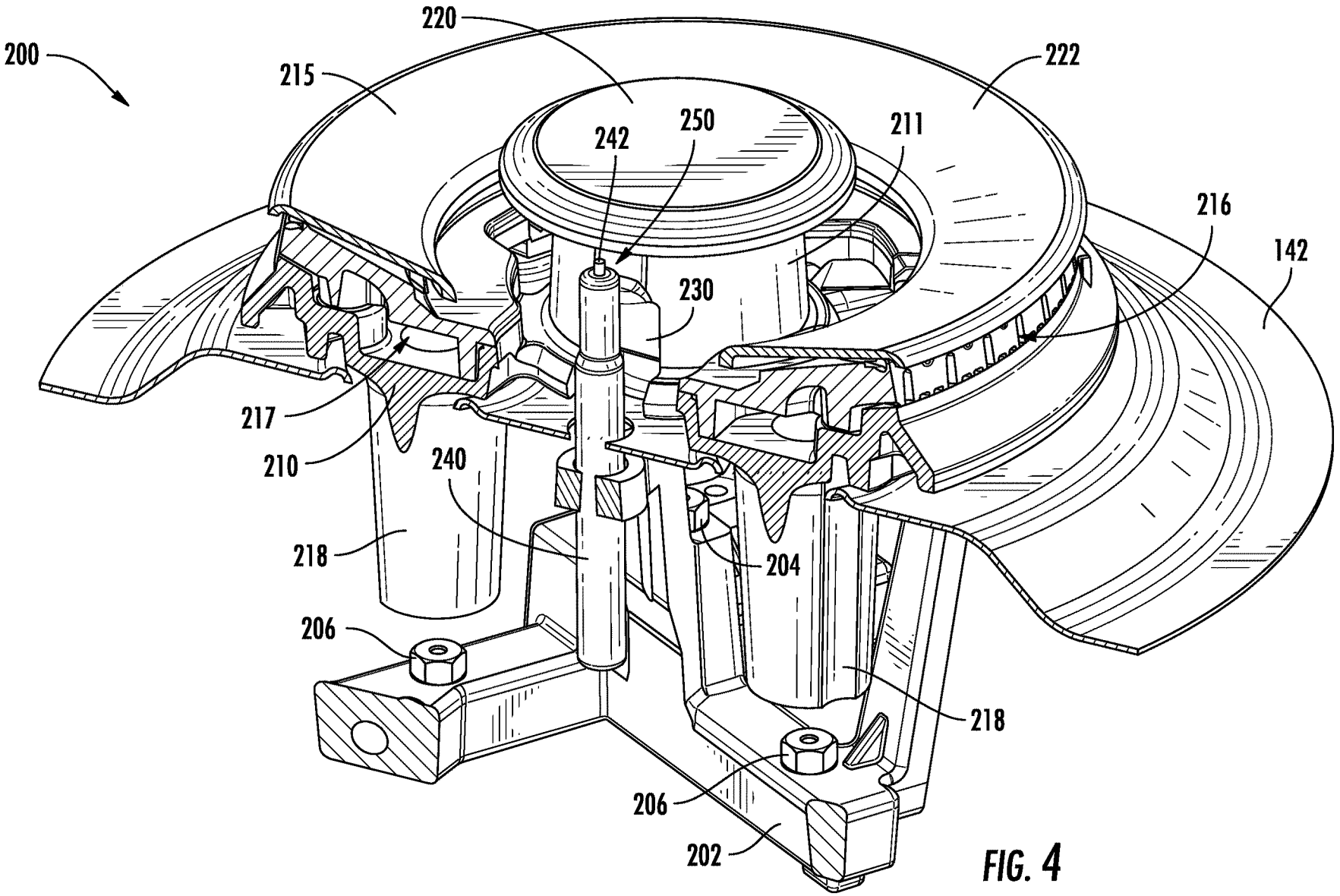
FIG. 4 is another perspective, partial section view of the example gas burner of FIG. 3.
Figure 5:
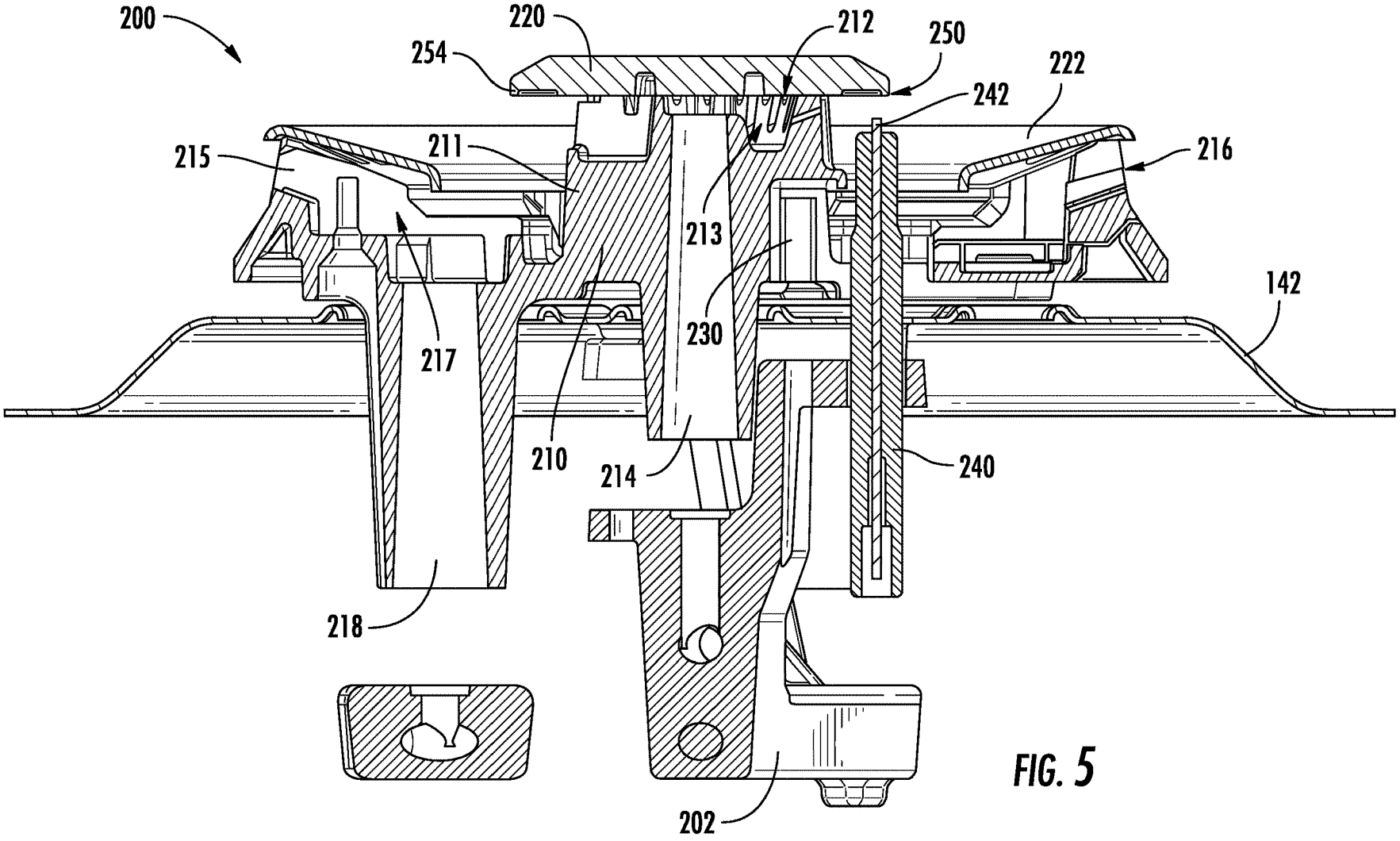
FIG. 5 is another section view of the example gas burner of FIG. 3.

As shown in FIGS. 3 and 4, gas burner assembly 200 may include a ring base or base body 210 and a cap 220. Base body 210 may be positioned on top panel 142, and cap 220 may be positioned on base body 210. Base body 210 and cap 220 may collectively define a plurality of flame ports 212 (FIG. 5). For example, cap 220 may be positioned on base body 210 to form the top wall of flame ports 212. Flame ports 212 may be circumferentially distributed on a central post 211 of base body 210. Flame ports 212 may be configured for directing a flow of gaseous fuel and air out of a fuel chamber 213 of base body 210 and cap 220. Outside of flame ports 212, the gaseous fuel may be combusted to generate heat for cooking. As shown in FIG. 5, base body 210 may include a Venturi mixing tube 214 that is contiguous with fuel chamber 213. For example, Venturi mixing tube 214 may extend downwardly from fuel chamber 213. An open end of Venturi mixing tube 214 may face a fuel orifice 204 (FIG. 4) mounted on an injet 202 below base body 210. Fuel orifice 204 may be positioned and oriented for directing a flow of gaseous fuel (such as propane or natural gas) from a supply line mounted to injet 202 towards Venturi mixing tube 214. Fuel orifice 204 may be spaced from Venturi mixing tube 214, and the flow gaseous fuel from fuel orifice 204 may entrain air into Venturi mixing tube 214. Within Venturi mixing tube 214, the gaseous fuel and air may mix prior to entering fuel chamber 213 in order to facilitate combustion of the gaseous fuel at flame ports 212.

Base body 210 may include an outer ring body 215 and an outer cap 222. Outer ring body 215 and outer cap 222 may also collectively define a plurality of flame ports 216, and flame ports 216 of outer ring body 215 may be distributed circumferentially around flame ports 212 on central post 211. Thus, flame ports 212 on central post 211 may define an inner burner ring and flame ports 216 on outer ring body 215 may define an outer burner ring in certain example embodiments such that gas burner assembly 200 may be referred to as a multi-ring gas burner. However, it will be understood that the present subject matter is not limited to multi-ring burner arrangements and may be used in or with single-ring burner arrangements in alternative example embodiments.

Flame ports 216 of outer ring body 215 may also be configured for directing a flow of gaseous fuel and air out of an outer fuel chamber 217 of base body 210 and outer cap 222. Outside of flame ports 216, the gaseous fuel may be combusted to generate heat for cooking. As shown in FIG. 4, base body 210 may include one or more Venturi mixing tubes 218 that are contiguous with outer fuel chamber 217. For example, Venturi mixing tubes 218 may extend downwardly from outer fuel chamber 213. An open end of Venturi mixing tubes 218 may face fuel orifice(s) 206 mounted on injet 202 below base body 210. Fuel orifices 206 may be positioned and oriented for directing a flow of gaseous fuel (such as propane or natural gas) from a supply line mounted to injet 202 towards Venturi mixing tubes 218. Fuel orifices 206 may be spaced from Venturi mixing tubes 218, and the flow gaseous fuel from fuel orifices 206 may entrain air into Venturi mixing tubes 218. Within Venturi mixing tubes 218, the gaseous fuel and air may mix prior to entering outer fuel chamber 217 in order to facilitate combustion of the gaseous fuel at flame ports 216.

Figure 9:
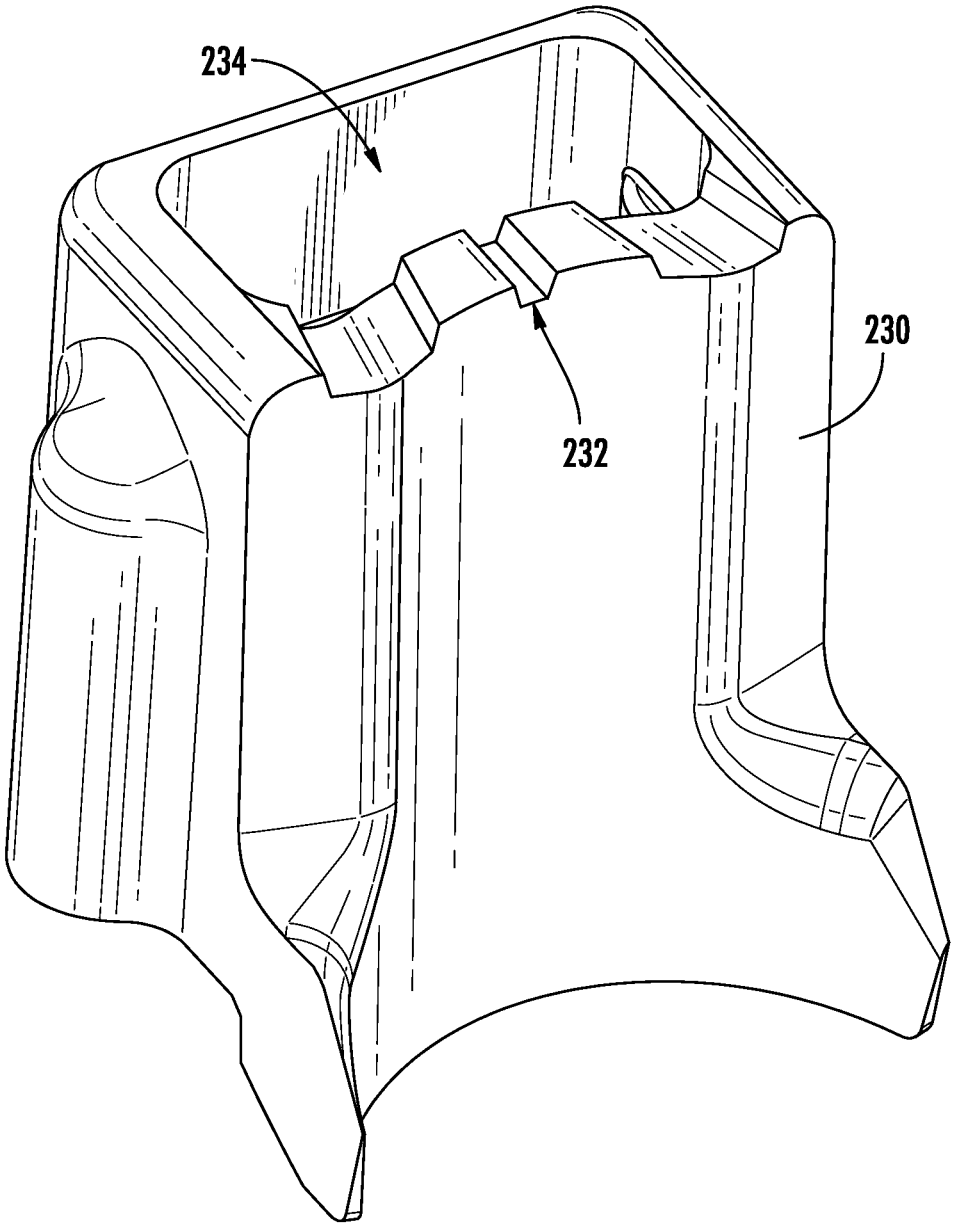
FIG. 9 is a top, perspective view of the pilot insert of the example gas burner of FIG. 3.
Figure 10:
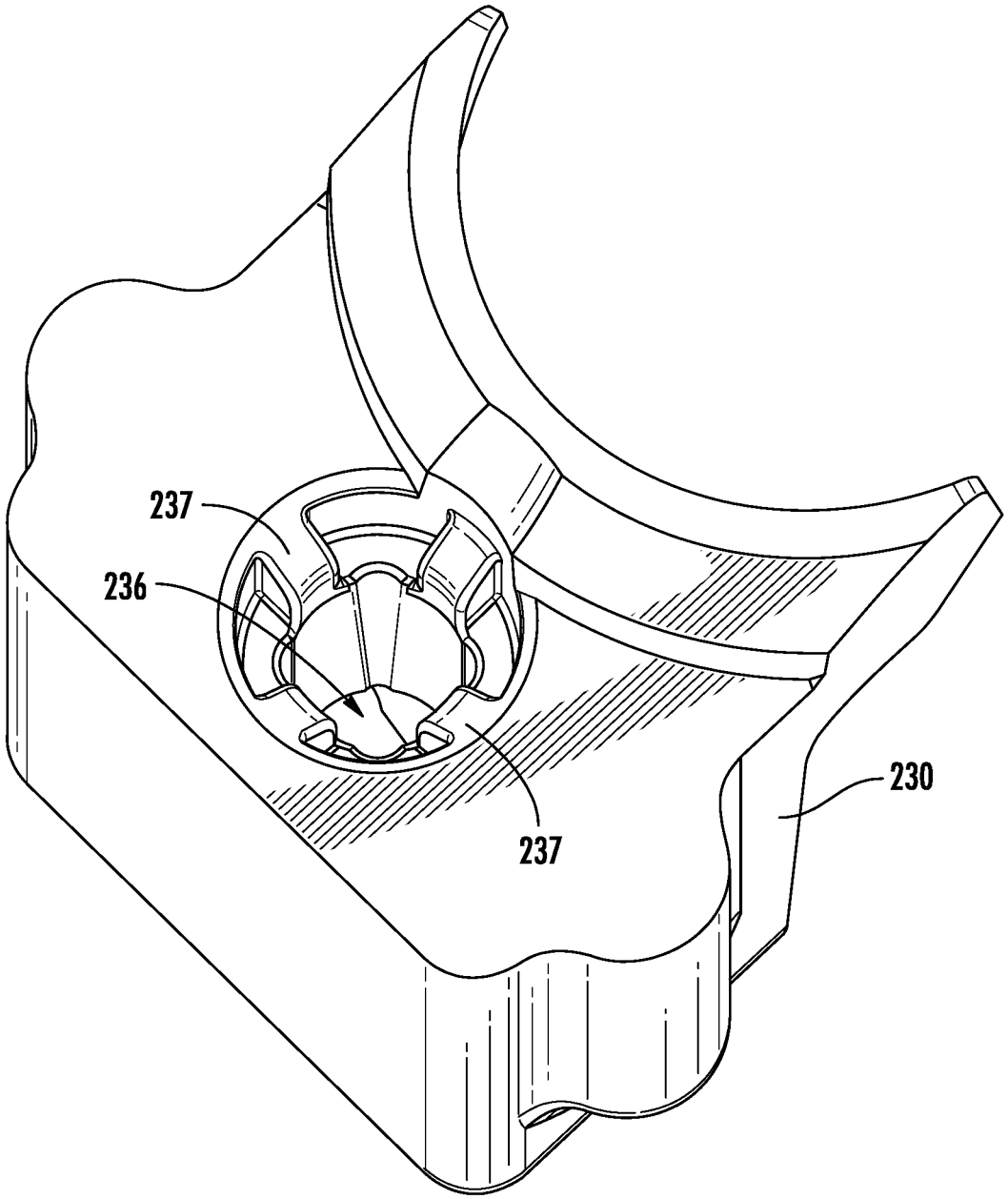
FIG. 10 is a bottom, perspective view of the pilot insert of the example gas burner of FIG. 3.

Gas burner assembly 200 also includes a pilot insert 230. Pilot insert 230 may be mounted to base body 210, e.g., with fasteners at a bottom of base body 210. When pilot insert 230 is mounted to base body 210, pilot insert 230 and base body 210 may collectively defining at least one pilot port 232, such as two (2), three (3), four (4), five (5), or more pilot ports 232. Pilot port 232 may be positioned below flame ports 212, e.g., on central post 211. In addition, cap 220 may extend radially over pilot port 232. Pilot port 232 may be configured for directing a flow of gaseous fuel and air out of a fuel chamber 234 of pilot insert 230 and base body 210. Outside of pilot port 232, the gaseous fuel may be combusted to generate heat. As shown in FIGS. 9 and 10, pilot insert 230 may define a passage 236, e.g., within pilot insert 230. Passage 236 may be in fluid communication with pilot port 232, and a fuel supply line 238 (FIG. 7) for pilot port 232 may be mountable to pilot insert 230 at passage 236. For instance, fuel supply line 238 may be inserted into passage 236. Gaseous fuel from fuel supply line 238 may flow from fuel supply line 238 into fuel chamber 234 and then exit via pilot port 232. In certain example embodiments, pilot insert 230 may include a plurality of ribs 237 at passage 236. In particular, ribs 237 may extend into passage 236. Fuel supply line 228 may be mountable to pilot insert 230 on ribs 237. With fuel supply line 228 positioned within passage 236 on ribs 237, air may be entrained into passage 236 between ribs 237 into fuel chamber 234, where the air may mix with gaseous fuel from fuel supply line 228, and then exit via pilot port 232. The air may facilitate combustion of the gaseous fuel at pilot port 232. The flame at pilot port 232 may provide a discrete low heat output that is less than a minimum heat output of flame ports 212. The discrete low heat output of pilot port 232 can be used for low temperature cooking, such as sous vide style cooking, without a need to cycle the burner off to maintain a temperature.

A total outlet area of pilot port 232 may be significantly less than a total output area of flame ports 212. For instance, the total outlet area of pilot port 232 may be less than half (½), less than a quarter (¼), less than an eighth (⅛), etc. of the total output area of flame ports 212. Such relative total outlet area difference between pilot port 232 and flame ports 212 may facilitate the low heat output of pilot port 232 relative to flame ports 212.

Gas burner assembly 200 further includes an igniter 240, e.g., mounted to injet 202. Igniter 240 may be a different height depending on whether gas burner assembly 200 is configured in a non-pilot flame configuration (FIG. 4) or a pilot flame configuration (FIG. 9). Thus, igniter 240 may be switched depending upon the selected configuration. Igniter 240 is configured to generate an ignition spark. For example, a portion of gas burner assembly 200 may be grounded, and a voltage differential between an electrode 242 of igniter 240 and the grounded portion of gas burner assembly 200 may generate the ignition spark. As discussed in greater detail below, gas burner assembly 200 includes different spark targets. Electrode 242 of igniter 240 may be positioned proximate a respective one of the spark targets depending upon the selected operating arrangement of gas burner assembly 200, as discussed in greater detail below.

Figure 7:
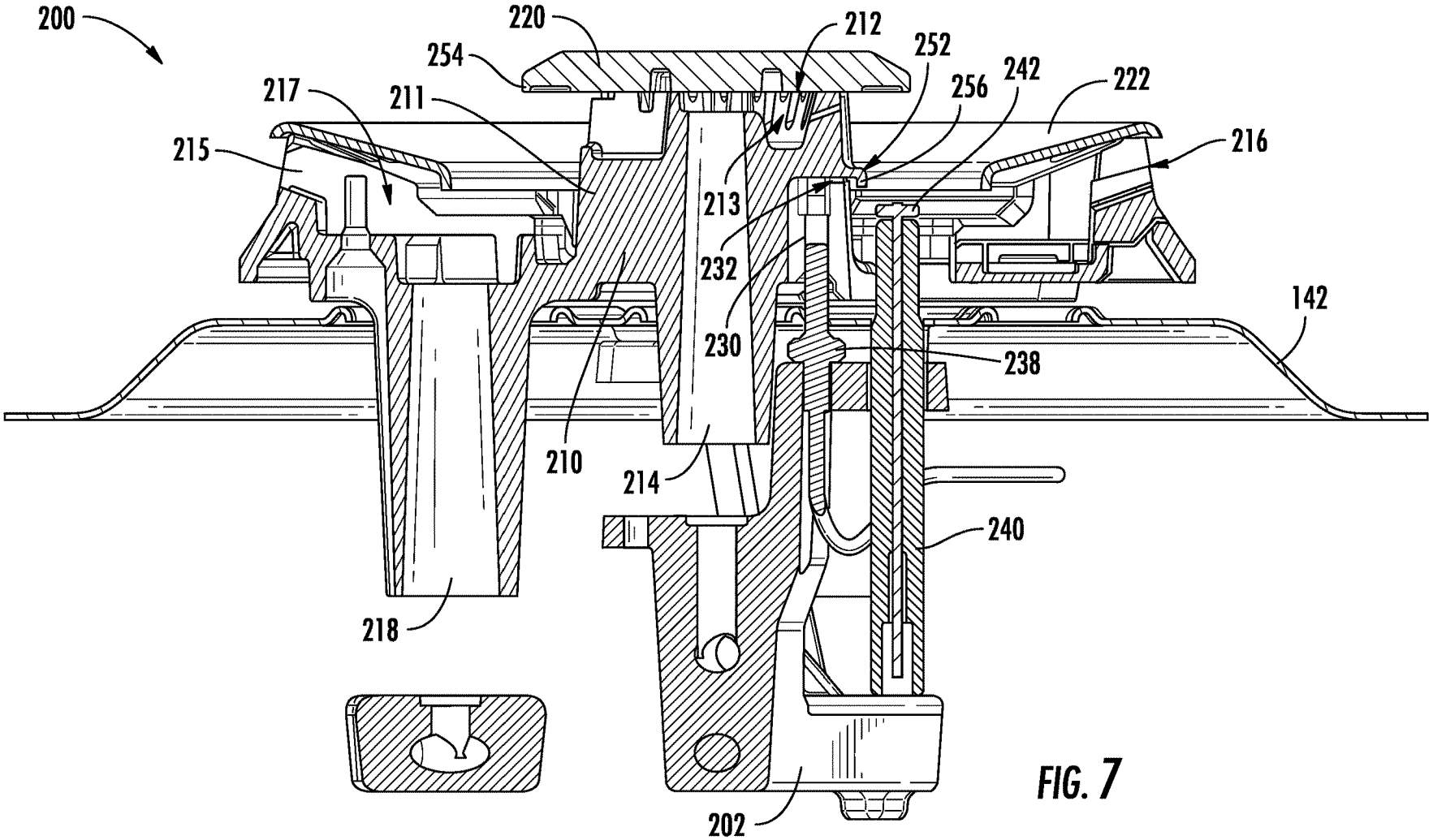
FIG. 7 is another section view of the example gas burner of FIG. 6.
Figure 8:
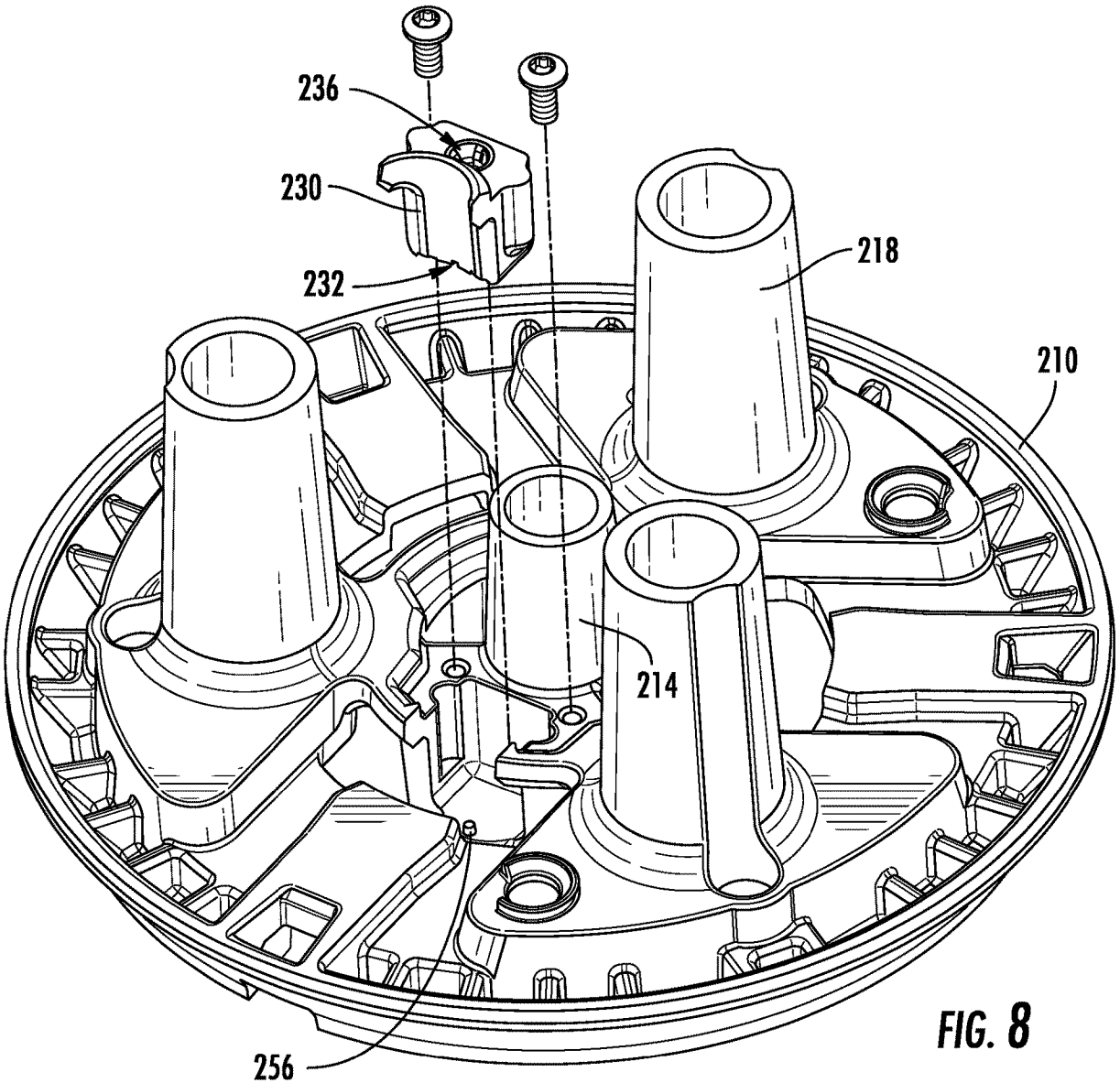
FIG. 8 is a partially exploded bottom, perspective view of a base body and a pilot insert of the example gas burner of FIG. 3.

With reference to FIGS. 5 and 7, gas burner assembly 200 may includes an upper spark target 250 positioned proximate flame ports 212. Gas burner assembly 200 may also include a lower spark target 252 positioned proximate pilot port 232. Electrode 242 of igniter 240 may be positioned proximate either upper spark target 250 or lower spark target 252. For instance, as shown in FIG. 5, electrode 242 of igniter 240 may be positioned proximate upper spark target 250 when gas burner assembly 200 is configured in a non-pilot flame configuration. Pilot port 232 may be inoperable or not suppliable with gaseous fuel when gas burner assembly 200 is configured in the non-pilot flame configuration. Thus, e.g., fuel supply line 238 may not be inserted into passage 236. Conversely, as shown in FIG. 7, electrode 242 of igniter 240 may be positioned proximate lower spark target 252 when gas burner assembly 200 is configured in a pilot flame configuration. Pilot port 232 may be operable and suppliable with gaseous fuel when gas burner assembly 200 is configured in the pilot flame configuration. Thus, e.g., fuel supply line 238 may be inserted into passage 236.

By positioning electrode 242 of igniter 240 proximate upper spark target 250 when gas burner assembly 200 is configured in the non-pilot flame configuration, the ignition spark between electrode 242 of igniter 240 and upper spark target 250 may ignite gaseous fuel exiting flame ports 212. Thus, igniter 240 may be configured to ignite gaseous fuel at flame ports 212 when gas burner assembly 200 is configured in the non-pilot flame configuration. Conversely, by positioning electrode 242 of igniter 240 proximate lower spark target 252 when gas burner assembly 200 is configured in the pilot flame configuration, the ignition spark between electrode 242 of igniter 240 and lower spark target 252 may ignite gaseous fuel exiting pilot port 232. Thus, igniter 240 may be configured to ignite gaseous fuel at pilot port 232 when gas burner assembly 200 is configured in the pilot flame configuration.

Figure 6:
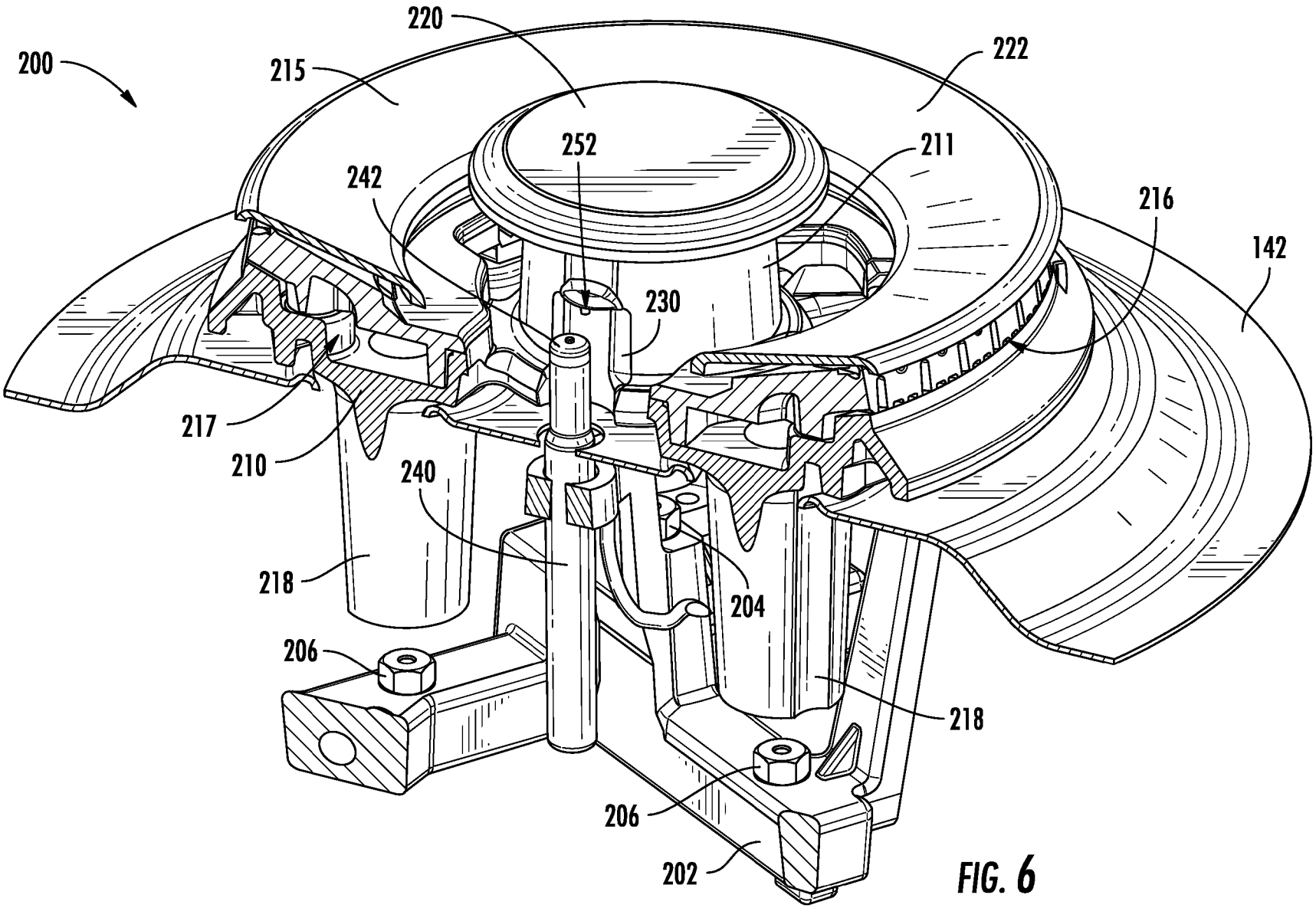
FIG. 6 is a perspective, partial section view of the example gas burner of FIG. 3 in a pilot configuration.

Electrode 242 of igniter 240 may be a different type in the non-pilot flame configuration and the pilot flame configuration. For example, as shown in FIG. 6, electrode 242 of igniter 240 may be a nail head electrode in the pilot flame configuration. Conversely, as shown in FIG. 4, electrode 242 of igniter 240 may be a pin electrode in the non-pilot flame configuration. Thus, a diameter of electrode 242 may be larger in the pilot flame configuration relative to the non-pilot flame configuration.

In certain example embodiments, cap 220 may define upper spark target 250 for flame ports 212. For instance, upper spark target 250 may include a ledge 254 of cap 220, e.g., that extends around an outer edge of cap 220 and/or extends downwardly toward flame ports 212. Base body 210 may define lower spark target 252 for pilot port 232. For example, lower spark target 252 may include a projection 256 positioned at pilot port 232. In particular, projection 256 may be formed on base body 210 above pilot port 232. Upper spark target 250 may also be aligned lower spark target 252.

As may be seen from the above, gas burner assembly 200 may be configured to operate with or without a pilot feature. When configured without the pilot feature, the spark target for ignition may be located at a burner flame ring. Conversely, when configured with the pilot function, an interface between a pilot insert and the burner body may define a set of pilot flame ports for the pilot feature. A spark target for ignition may be located at the pilot flame ports when configured with the pilot function. A height of an electrode may be adjusted between the upper and lower spark targets depending on the selected operating mode, e.g., by switching the igniter. A pilot orifice may introduce discrete fuel into a fuel chamber for the pilot flame ports, with primary air entrained and mixed with fuel above a cooktop level to limit the impact of pressure disturbances from within the appliance interior on the pilot flame, e.g., such as when an oven door is snapped open or shut quickly. Thus, the pilot flame may be less susceptible to extinguishing at low power rates.

Heat from the pilot flames may heat a cap above the pilot flame. Thus, the cap may diffuse the heat such that the pilot flame is less likely to scorch a localized hot spot. With the pilot flame, the gas burner may operate with a closed loop control to provide any heat to cookware between a highest burner output and the pilot flame heat output. The pilot flame may also restore ignition to burner ports. The pilot flame heat output may be low enough for low temperature cooking tasks, such as sous vide, melting chocolates, etc.

Gas burner assembly 200 may thus be configured with or without a pilot flame, e.g., without a change to burner parts, only additions to gas burner assembly 200. The pilot flame at pilot port 232 may be protected from spills by cap 220 and not require significant space. The pilot flame may expand a heat output range of gas burner assembly 200, without introducing dead spots.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A burner assembly, comprising:

a ring base;

a cap positioned on the ring base such that the ring base and the cap collectively define a plurality of flame ports;

a pilot insert mounted to the ring base below the plurality of flame ports, the pilot insert and the ring base collectively defining a pilot port; and an igniter configured to generate an ignition spark, wherein the cap defines an upper spark target for the plurality of flame ports, the ring base defines a lower spark target for the pilot port, and the upper spark target is aligned with the lower spark target, and wherein an electrode of the igniter is positionable proximate either the upper spark target or the lower spark target.

2. The burner assembly of claim 1, wherein the electrode of the igniter is positioned proximate the lower spark target when the burner assembly is arranged in a pilot flame configuration.

3. The burner assembly of claim 2, wherein the electrode of the igniter is a nail head electrode.

4. The burner assembly of claim 1, wherein the electrode of the igniter is positioned proximate the upper spark target when the burner assembly is arranged in a non-pilot flame configuration.

5. The burner assembly of claim 1, wherein the cap is an inner cap and the plurality of flame ports is a plurality of inner flame ports, the burner assembly further comprising an outer cap positioned on the ring base such that the ring base and the outer cap collectively define a plurality of outer flame ports that are positioned radially outward of the plurality of inner flame ports.

6. The burner assembly of claim 1, wherein the pilot insert defines a passage that is in fluid communication with the pilot port, the pilot insert configured such that a fuel supply line for the pilot port is mountable to the pilot insert at the passage.

7. The burner assembly of claim 6, wherein the pilot insert comprising a plurality of ribs that extend into the passage, the pilot insert configured such that the fuel supply line for the pilot port is mountable to the pilot insert on the plurality of ribs and air is flowable through the passage between the plurality of ribs to the pilot port.

8. The burner assembly of claim 1, wherein the cap extends radially over the pilot port.

9. The burner assembly of claim 1, wherein the pilot insert is fastened to the ring base at a bottom surface of the ring base.

10. The burner assembly of claim 1, further comprising an injet and a fuel orifice, the fuel orifice mounted to the injet such that the fuel orifice is oriented for directing a flow of gaseous fuel from a supply passage of the injet towards the plurality of flame ports, the injet positioned below the ring base, the igniter mounted to the injet.

11. A burner assembly, comprising:

a base body;

a cap positioned on the base body such that the base body and the cap collectively define a plurality of flame ports;

a pilot insert mounted to the base body, the pilot insert and the base body collectively defining a pilot port, the pilot port positioned below the plurality of flame ports; and an igniter configured to generate an ignition spark, wherein an upper spark target is positioned proximate the plurality of flame ports, a lower spark target is positioned proximate the pilot port, and an electrode of the igniter is positionable proximate either the upper spark target or the lower spark target.

12. The burner assembly of claim 11, wherein the electrode of the igniter is positioned proximate the lower spark target when the burner assembly is arranged in a pilot flame configuration.

13. The burner assembly of claim 12, wherein the electrode of the igniter is a nail head electrode.

14. The burner assembly of claim 11, wherein the electrode of the igniter is positioned proximate the upper spark target when the burner assembly is arranged in a non-pilot flame configuration.

15. The burner assembly of claim 11, wherein the cap is an inner cap and the plurality of flame ports is a plurality of inner flame ports, the burner assembly further comprising an outer cap positioned on the base body such that the base body and the outer cap collectively define a plurality of outer flame ports that are positioned radially outward of the plurality of inner flame ports.

16. The burner assembly of claim 11, wherein the pilot insert defines a passage that is in fluid communication with the pilot port, the pilot insert configured such that a fuel supply line for the pilot port is mountable to the pilot insert at the passage.

17. The burner assembly of claim 16, wherein the pilot insert comprising a plurality of ribs that extend into the passage, the pilot insert configured such that the fuel supply line for the pilot port is mountable to the pilot insert on the plurality of ribs and air is flowable through the passage between the plurality of ribs to the pilot port.

18. The burner assembly of claim 11, wherein the cap extends radially over the pilot port.

19. The burner assembly of claim 11, further comprising an injet and a fuel orifice, the fuel orifice mounted to the inject such that the fuel orifice is oriented for directing a flow of gaseous fuel from a supply passage of the injet towards the plurality of fuel ports, the injet positioned below the base body, the igniter mounted to the injet.

20. The burner assembly of claim 11, wherein the upper spark target comprises a ledge of the cap, and the lower spark target comprises a projection positioned at the pilot port.

* * * * *